US007982163B2

(12) United States Patent
Chung et al.

(10) Patent No.: US 7,982,163 B2
(45) Date of Patent: Jul. 19, 2011

(54) HEAT GUN

(75) Inventors: Kwok Wah Chung, Hongkong (HK); Han Jun Deng, Dongguan (CN)

(73) Assignee: Black & Decker Inc., Newark, DE (US)

( * ) Notice: Subject to any disclaimer, the term of this patent is extended or adjusted under 35 U.S.C. 154(b) by 207 days.

(21) Appl. No.: 12/492,436

(22) Filed: Jun. 26, 2009
(Under 37 CFR 1.47)

(65) Prior Publication Data

US 2010/0065545 A1 Mar. 18, 2010

(30) Foreign Application Priority Data

Jun. 26, 2008 (GB) ..... 0811724.4

(51) Int. Cl.
*F24H 3/00* (2006.01)
*F16M 13/00* (2006.01)

(52) U.S. Cl. ..... 219/242; 219/227; 392/382; 392/385; 248/163.1; 248/170; 248/434; 248/188.8; 248/677

(58) Field of Classification Search ..... None
See application file for complete search history.

(56) References Cited

U.S. PATENT DOCUMENTS 1,700,876 A 2/1929 Blitz
1,716,580 A * 6/1929 Duhamel ..... 219/520
2,056,951 A 10/1936 Bohall
2,295,075 A 9/1942 Burrows
2,662,962 A * 12/1953 Green ..... 30/140
3,184,195 A * 5/1965 Wahl et al. ..... 248/158
3,209,988 A 10/1965 Fox
D288,841 S * 3/1987 Steinel et al. ..... D23/332
D293,020 S * 12/1987 Steinel et al. ..... D23/332
4,776,124 A * 10/1988 Clifton ..... 42/94
6,170,709 B1 * 1/2001 Huang ..... 222/146.5
D456,681 S 5/2002 Cheng
D458,524 S * 6/2002 Cheng ..... D8/29.1
D461,383 S * 8/2002 Blackburn ..... D8/29.1
D615,834 S * 5/2010 Netzler ..... D8/29.1
D615,835 S * 5/2010 Netzler ..... D8/29.1
7,775,403 B2 * 8/2010 Monfeli et al. ..... 222/173
2003/0235462 A1 * 12/2003 Cheng ..... 403/329

OTHER PUBLICATIONS

Larsen, Intellectual Property Office Search Report, Oct. 2, 2008, United Kingdom.

* cited by examiner

*Primary Examiner* — Joseph M Pelham
(74) *Attorney, Agent, or Firm* — Adan Ayala

(57) ABSTRACT

A heat gun has a body with a support mechanism mounted on the handle. The support mechanism includes at least one arm moveably mounted on the handle and which is capable of moving between a first retracted position and a second extended position. The at least one arm, when it is in its extended position, is capable of co-operating with the body to form a platform upon which the heat gun can rest on a work surface while the nozzle is placed remotely from the work surface.

11 Claims, 8 Drawing Sheets

HEAT GUN

FIELD

The present invention relates to a heat gun.

BACKGROUND

A heat gun is a device which generates a flow of hot air for use in a variety of applications. A heat gun comprises a tubular body in which is located a fan. Air is drawn in at one end of the body by the operation of the fan and is blown out of the other end through a nozzle, after having passed over a heating element also located within the body which heats up the air as it passes over/or through the heating element.

U.S. Pat. Nos. 3,668,370 and 4,135,080 disclose heat guns.

The hot air is typically expelled from the body through a metal nozzle. The problem with such a design is that the nozzle can become extremely hot. Therefore, when an operator has finished using the heat gun, the heat gun cannot be simply placed on its side on a work surface as the heat from the nozzle can damage the work surface, at least until the nozzle has cooled. Therefore, the heat gun has to be either placed on a surface which is capable of withstanding the heat or on a surface where there is no concern if it becomes damaged.

Even if it is acceptable for damage to the surface to occur, the operator must ensure that the damage caused to the surface does not have an impact on the heat gun. For example, if the surface were made of plastic, it would not desirable for the plastic to become melted onto the nozzle.

Alternatively, it can be arranged for the heat gun to be placed on a surface in such a manner that the nozzle is located away from the work surface. One way of achieving this is to balance the heat gun on the work surface, assuming the shape of the heat gun provides suitable support for it to be balanced in such a manner. However, this provides either a heat gun which is unstable which can easily be knocked over or a heat gun which has a non-desirable shape. Furthermore, the instability is increased if the surface is not flat or is at an angle.

US Publication No. 2003/0235462 provides a heat gun having a support mechanism which improves the stability of the heat gun when placed on a work surface. However, the support mechanism is located on the base of the heat gun. This restricts the use of the base in providing air vents for the provision of air to operate the heat gun. Furthermore, the use of slidable wings results in a weak construction, and the wings are liable to break during use. Furthermore, the wings need to slide in grooves which tend to clog up during the use of such a heat gun.

SUMMARY

Accordingly there is provided a heat gun comprising a body, a fan assembly located within the body to generate an air flow, a heating device located within the body which, when activated, heats air which flows over and/or through the heating device, a nozzle mounted on the front of the body to direct the air flow from the body, wherein the fan assembly, when activated, blows air over the heating device and then through the nozzle, a base mounted on the rear of the body, and a handle connected to the body. A support mechanism is mounted on the handle remote from the base. The support mechanism comprises at least one arm moveably mounted on the handle and which is capable of moving between a first retracted position and a second extended position and wherein, when the at least one arm is in its extended position, is capable of co-operating with the base to form a platform upon which the heat gun can rest on a work surface whilst locating the nozzle remotely from the work surface.

The present invention provides a mechanism by which a heat gun can be placed on a surface so that the nozzle does not come into contact with the surface. Furthermore, the mechanism can be retracted so that, when the heat gun is in use, it does not interfere with the operation of the heat gun. Furthermore, it provides a robust design of support mechanism which does not interfere with the base.

BRIEF DESCRIPTION OF THE DRAWINGS

Two embodiments of the present invention will now be described with reference to the accompanying drawings of which.

DETAILED DESCRIPTION

Figure 1:
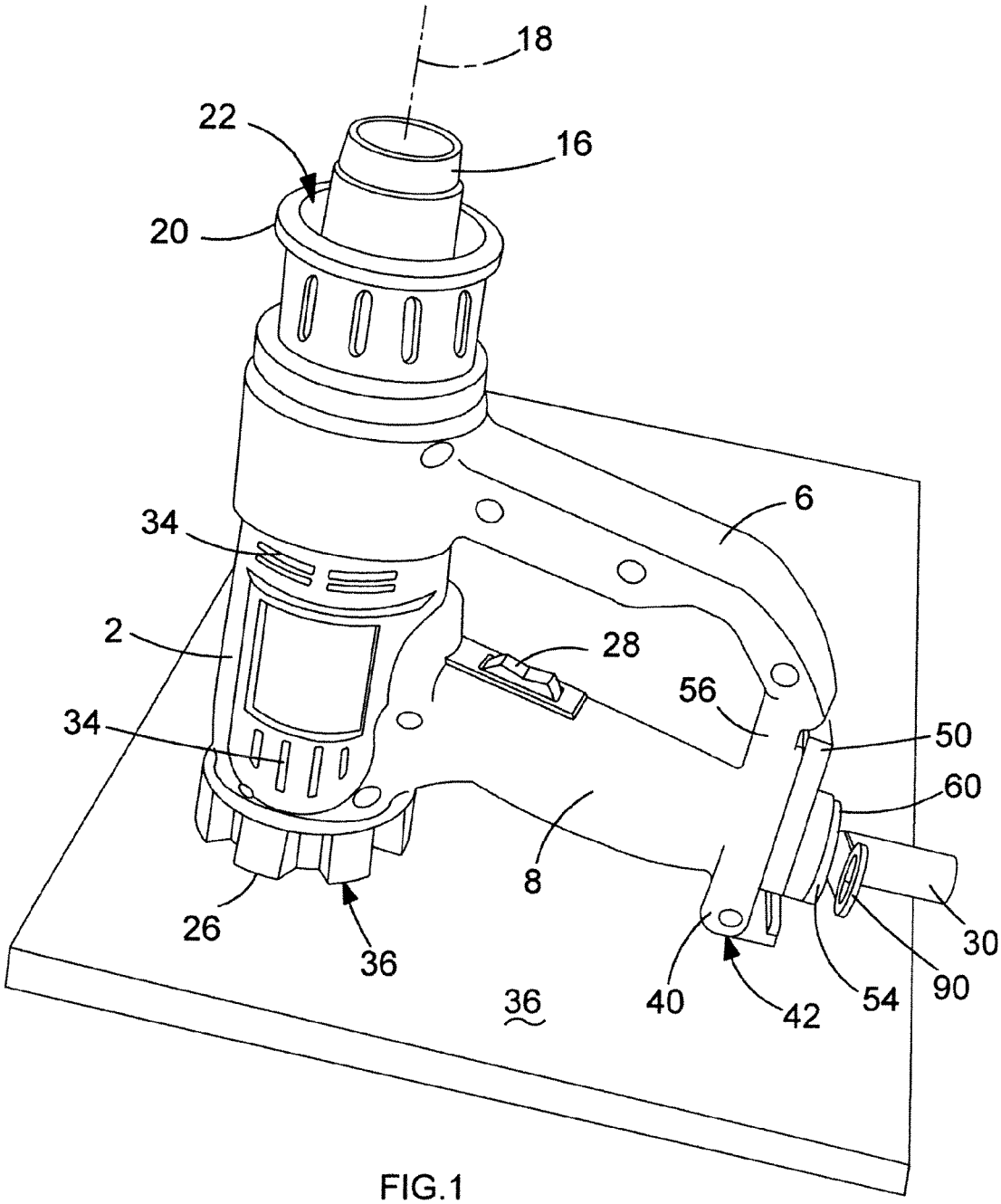
FIG. 1 shows a perspective view of the heat gun of the first embodiment located on a work surface with the support mechanism in the retracted position.
Figure 2:
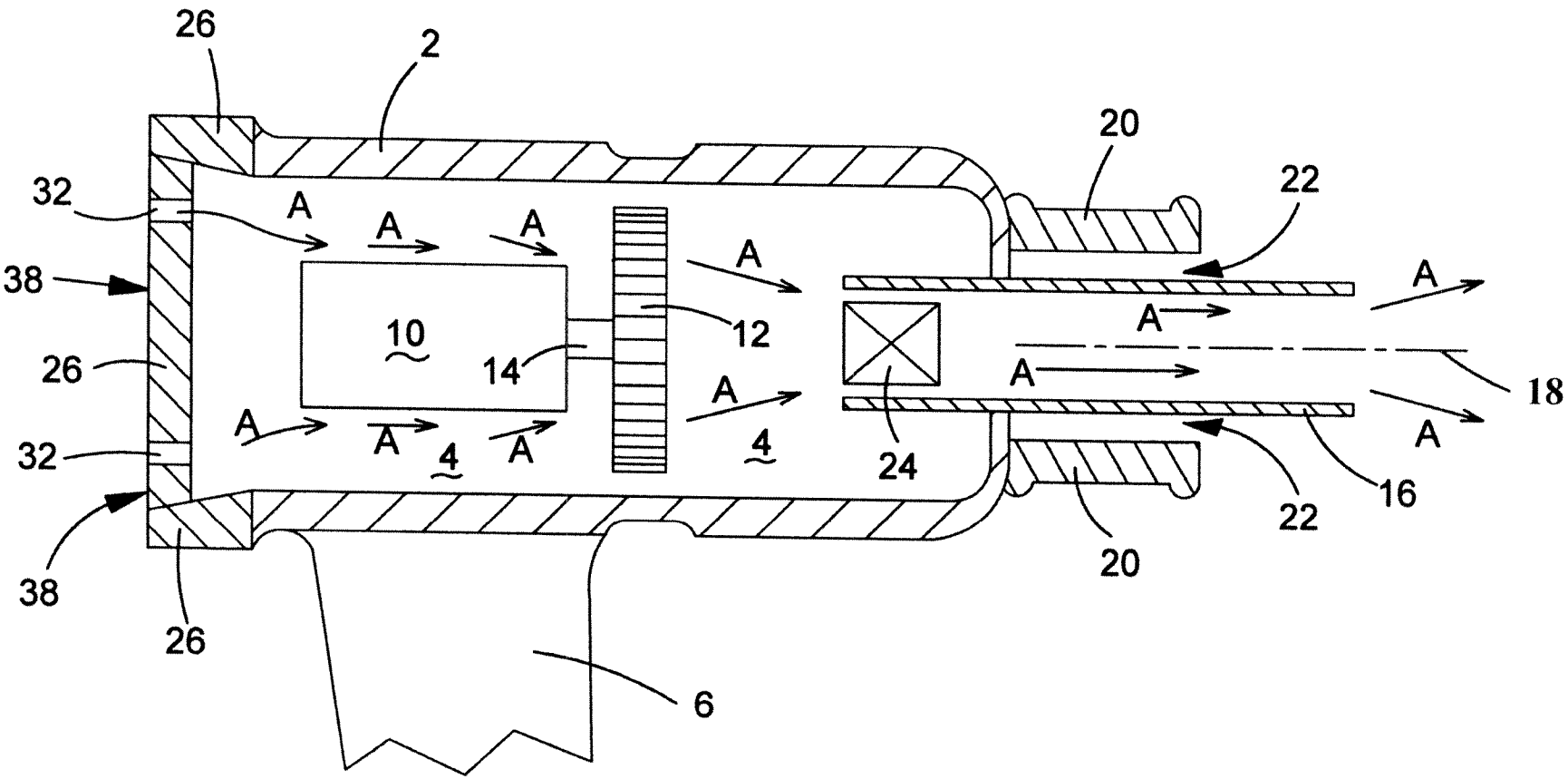
FIG. 2 shows a cross-sectional view of the heat gun.
Figure 3:
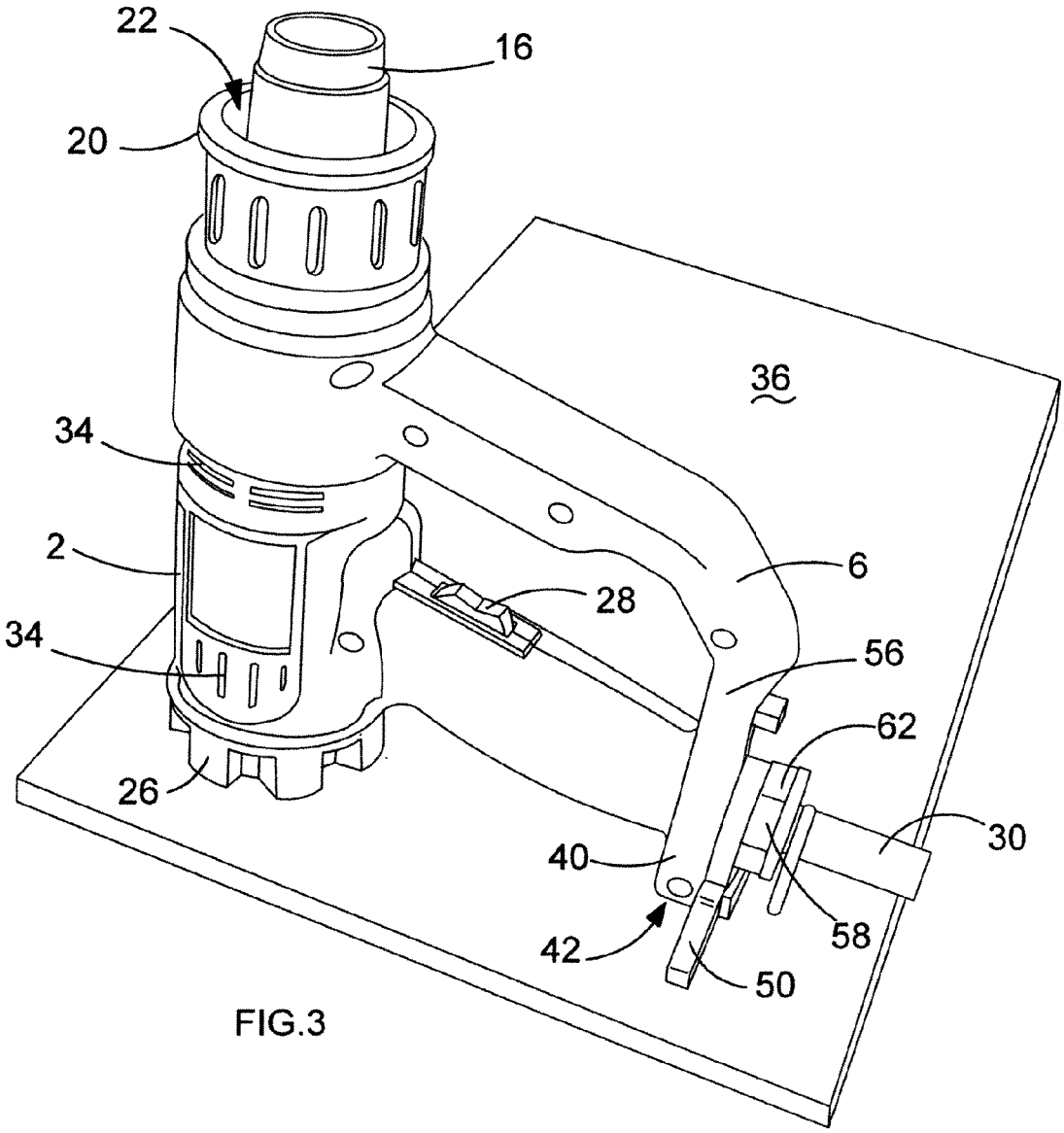
FIG. 3 shows a perspective view of the heat gun located on a work surface with the support mechanism in the extended position.

Referring to FIGS. 1 and 2, the heat gun preferably includes a tubular body 2. The passageway 4 formed by the body 2 preferably runs the length of the body 2 (see FIG. 2). A D-shaped handle 6 may have a grip portion 8 attached to the side of the body 2. The handle 6, particularly the grip portion 8, preferably extends in a generally perpendicular direction to a longitudinal axis 18 of the body 2.

An electric motor 10 is preferably located inside of the body 2. When activated, electric motor 10 may rotatingly drive a fan 12 mounted on its spindle 14 within the passageway 4.

A metal tubular nozzle 16 may be mounted on the front of the body 2. The longitudinal axis 18 of the nozzle 16 is preferably generally parallel to and co-axial with that of the passageway 4.

A plastic guard 20 may also be mounted on the front of the body 2. Plastic guard 20 preferably surrounds part of the length of the nozzle 16 as shown, and creates a gap 22 between the guard 20 and the nozzle 16. The guard 20 preferably limits the amount of nozzle 16 exposed to the operator and thus reduces the risk of the operator touching the nozzle 16 when it is hot. Nevertheless, the end of the nozzle 16 preferably extends beyond the end of the guard 20. The gap 22 preferably prevents the guard 20 from melting due to the heat from the nozzle 16.

A heating device 24 is preferably mounted inside of the nozzle 16, adjacent the end of the nozzle 16 within the body 2. The heating device 24 comprises electric heating elements which heat up when an electric current passes through them. Air is capable of flowing through and/or over the heating elements of the heating device 24. The heating device 24 preferably heats up any air which passes over and/or through the heating device 24 when it is activated by an electric current.

A base 26 may be mounted on the rear of the body 2. Base 26 preferably has a number of vents 32 formed through it.

An electric cable 30 may connect the motor 10 and heating device 24 via a toggle switch 28. The electric cable 30 is preferably connected to an electrical AC power source. With such arrangement, depression of the toggle switch 28 provides an electric current to the motor 10 and the heating device 24. When an electric current is provided to motor 10 and heating device 24, the electric motor 10 rotates, rotatingly driving the fan 12, and the heating device 24 becomes hot. Rotation of the fan 12 causes air to be drawn in through the vents 32 in base 26, across the motor 10, through the fan 12, over and/or through the heating device 24 where it is heated to a high temperature, and then through the nozzle 16 where it is expelled forward, as indicated by arrows A, in FIG. 2. Additional vents 34 are formed in the side wall of the body 2 immediately rearward and forward of the motor 10 through which air can also be drawn into the body 2. When the heat gun is running, the nozzle 16 may become very hot due to the hot air being blown through it.

Once an operator has finished using the heat gun, the operator may place the heat gun on a work surface 36. However, the nozzle 16 may remain hot and, if the nozzle 16 were to come into contact with the work surface 36, damage to the work surface 36 or nozzle 16 could result. Therefore the base 26 is provided with a flat rear surface 38.

A stop 40, having a flat surface 42, is preferably formed on the lower end 56 of the handle 6, below the grip 8. The heat gun could then be supported on to the work surface 36 by the being balanced on the flat surface 38 of the base 26 and the flat surface 42 of the stop 40 as shown in FIG. 1.

Figure 4:
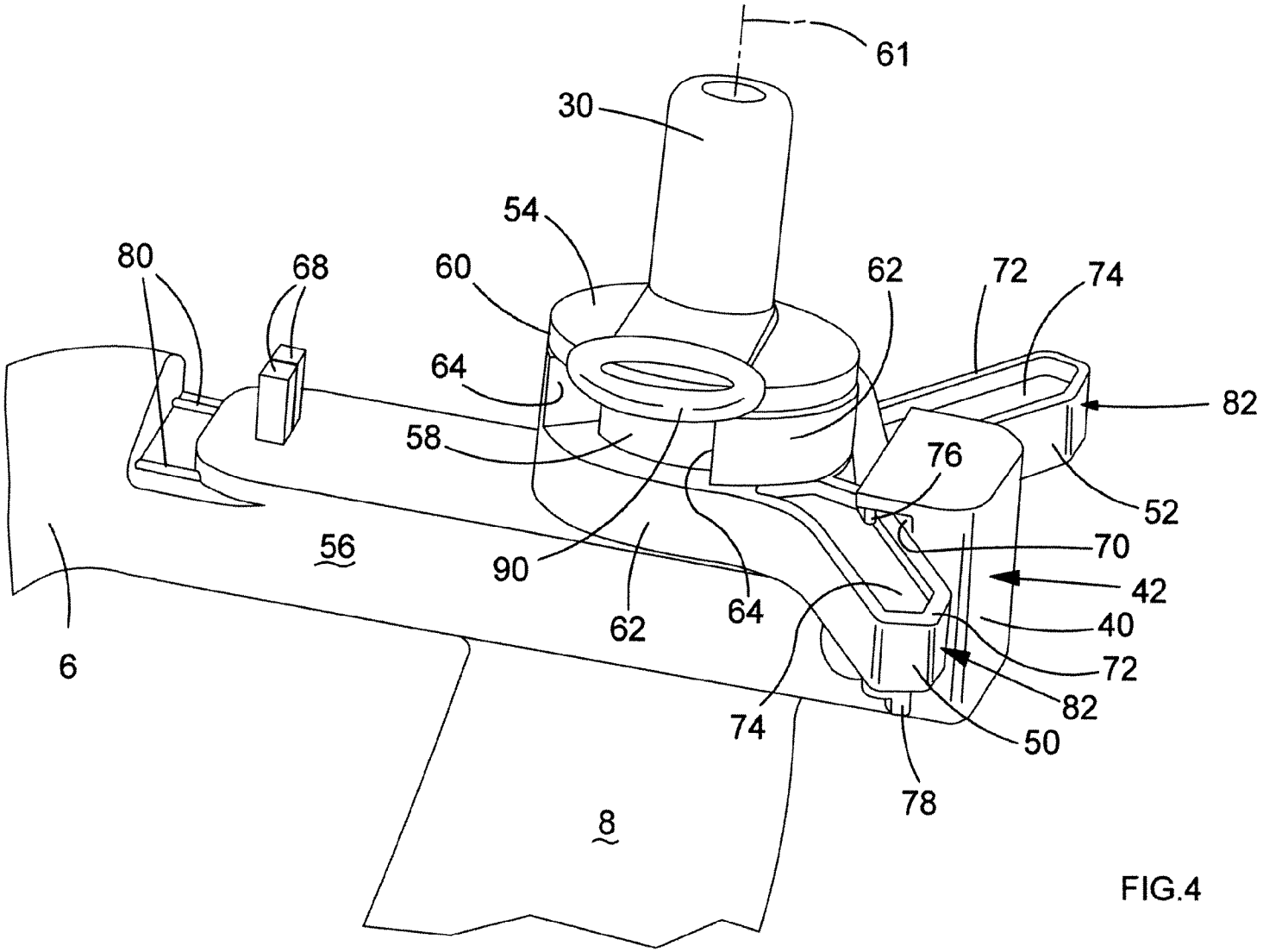
FIG. 4 shows a perspective view of the handle with the pivotal arms in the extended position.

In addition, the heat gun may have a supplemental support mechanism with two pivot arms 50, 52 which may be pivotally mounted on a circular stump 54 formed on the lower end 56 of the handle 6 remote from the base as shown in FIG. 4. The circular stump 54 may include a middle section 58 of uniform circular cross section and a radial flange 60 attached to the end of the middle section 58 remote from the lower end 56 of the handle 6. Each pivotal arm 50, 52 may include two circular arms 62 which have an inner diameter approximately equal to that of the middle section 58 of the stump 54.

A gap is preferably formed between the ends 64 of the circular arms 62. The circular arms 62 of each pivotal arm 50, 52 preferably wrap around the middle section 58 of the stump 54. The circular arms 62 of one pivotal arm 50 is preferably located by the side of and adjacent to, in the lengthwise direction of the stump 54, whereas the circular arms 62 of the other pivotal arm 52 is preferably located on the middle section 58, as shown in FIGS. 4, 6, 8 and 9. The radial flange 60 preferably prevents the radial arms 62 from sliding off the stump 54.

The circular arms 62 may be flexible so that, when the heat gun is manufactured, the middle section 58 can be forced through the gap formed by the ends 64 of the circular arms 62. Such gap would preferably increase to allow the middle section 58 to pass through it due to the circular arms 62 flexing.

Figure 6:
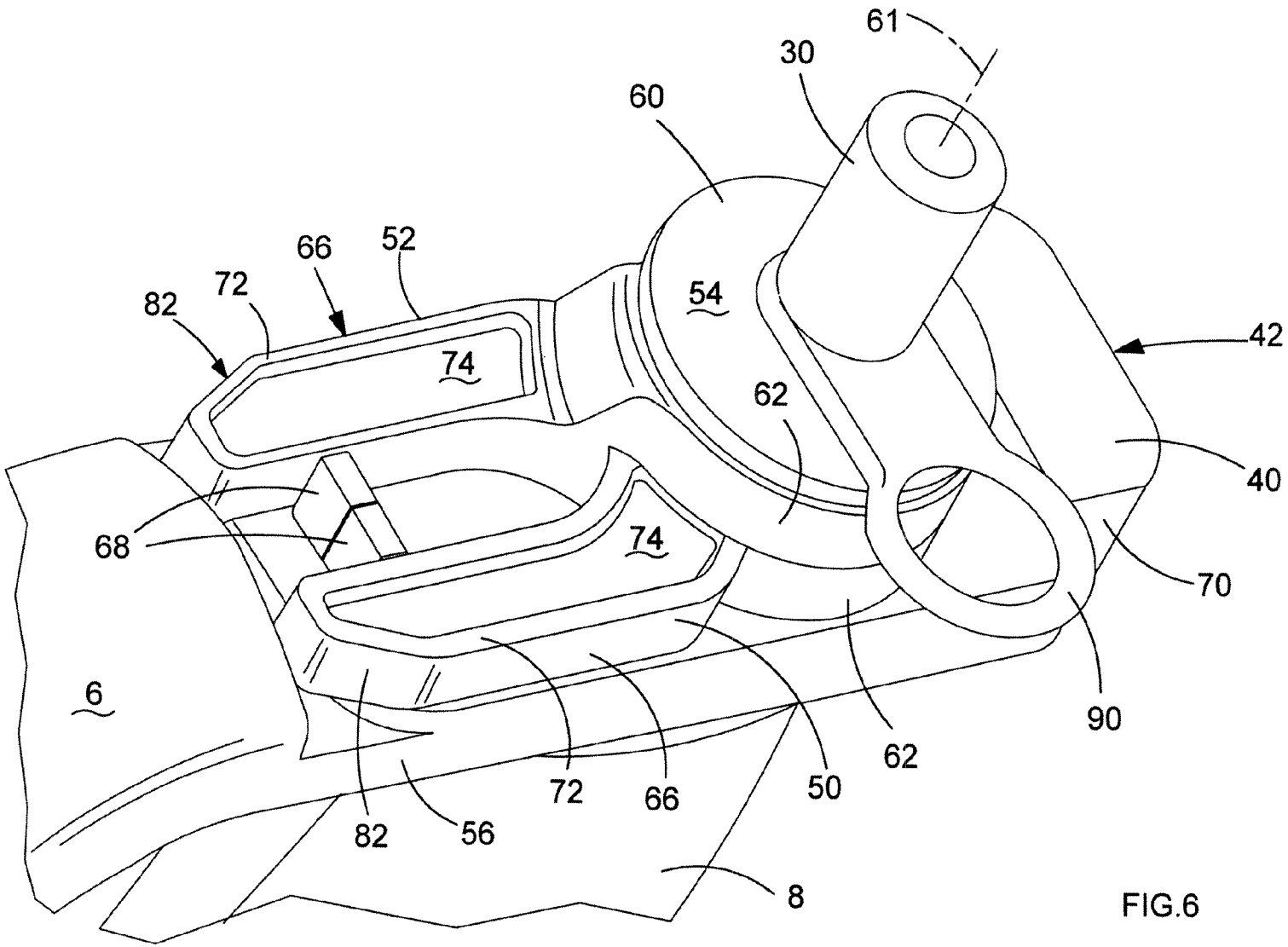
FIG. 6 shows a perspective view of the handle with the pivotal arms in the retracted position.

The construction of the two pivotal arms 50, 52 and their respective circular arms 62 may vary relative to each other so that, even though the circular arms 62 of each pivotal arm 50, 52 are located side by side in the lengthwise direction of the stump 54, adjacent each other on the middle section 58 as shown in FIGS. 4, 6, 8 and 9, the two pivotal arms may be located at the same position, in the lengthwise direction of the stump 54, along the middle section 58, as best seen in FIG. 6. As such, the pivotal arms 50, 52 may pivot within the same plane, which may be perpendicular about the longitudinal axis 61 of the stump 54.

The circular arms 62, and hence the pivotal arms 50, 52 may freely pivot on the middle section 58 of the stump 54. The pivotal movement of each pivotal arm 50, 52 is preferably independent of the pivotal movement of the other pivotal arm. Each pivotal arm 50, 52 can preferably pivot from a retracted position (both pivotal arms are shown their retracted positions in FIG. 6) to an extended position (both pivotal arms are shown their extended position in FIG. 5).

In the retracted position, the outer side 66 of each arm 50 52 is preferably flush with the sides of the lower end 56 of the handle 6. When both pivotal arms 50, 52 are retracted, they are preferably parallel to each other and parallel with longitudinal axis 18 of the body 2. The retracted position of each pivotal arm 50, 52 is determined by a peg 68 formed on the underside of the lower end 56 of the handle 6. When each arm 50, 52 is in its retracted position, it preferably abuts against its respective peg 68 as shown in FIG. 6.

Figure 5:
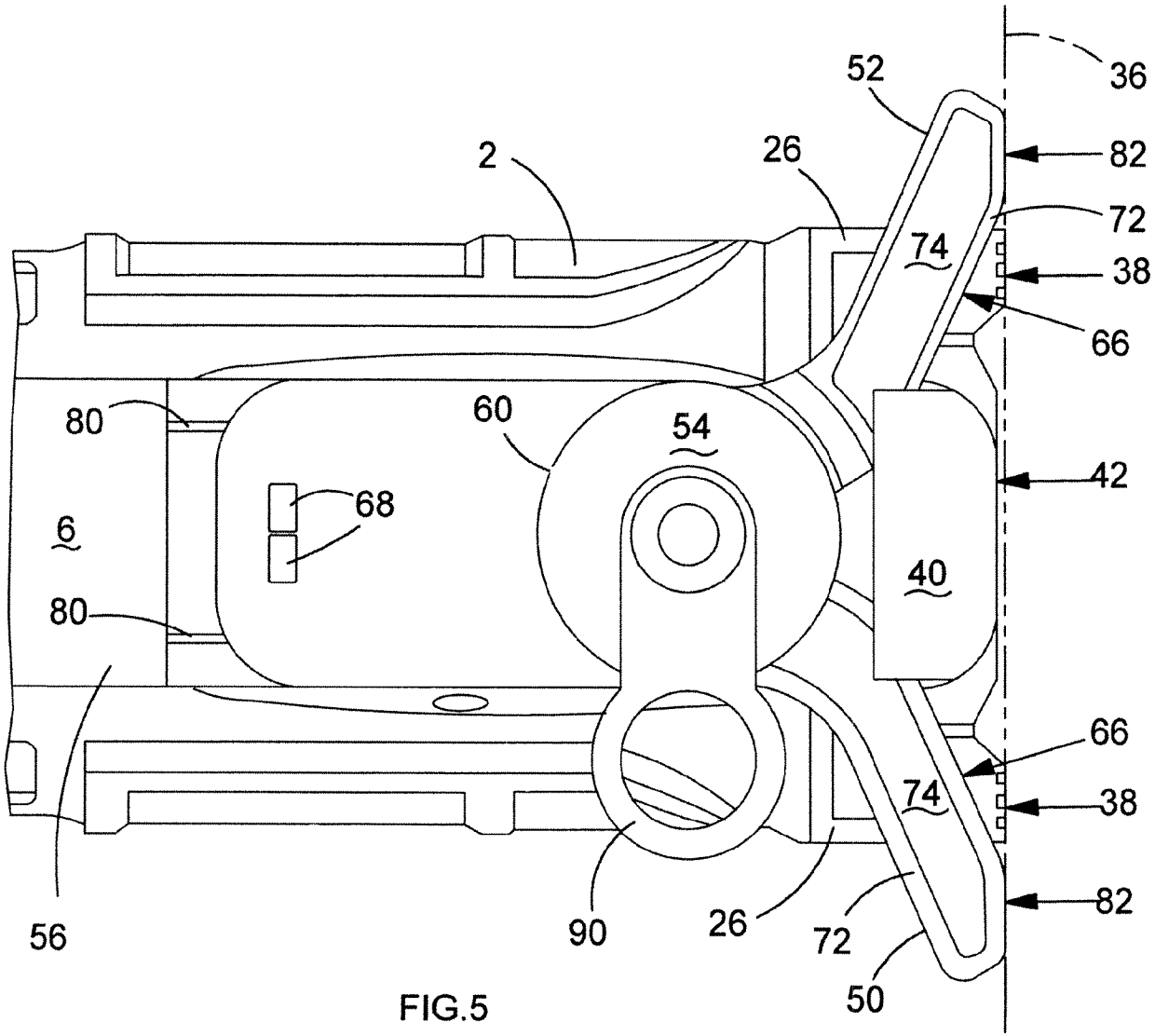
FIG. 5 shows a detailed view of the handle with the pivotal arms in the extended position.
Figure 9:
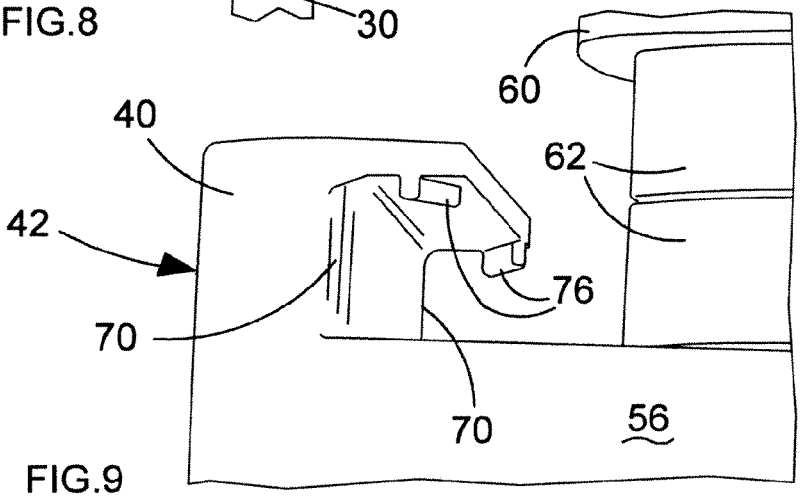
FIG. 9 shows a side view of part of the base of the handle with the pivotal arms in the retracted position.

In the extended position, each arm 50, 52 may extend outwardly at an angle in rearward direction as shown in FIG. 5. When both pivotal arms 50, 52 are extended, they are preferably symmetrical to each other. The extended position of each pivotal arm is preferably determined by an abutment surface 70 formed on the stop 40 as best seen in FIG. 9. When each pivotal arm 50, 52 is in its extended position, it preferably abuts against its respective abutment surface 70.

Figure 7:
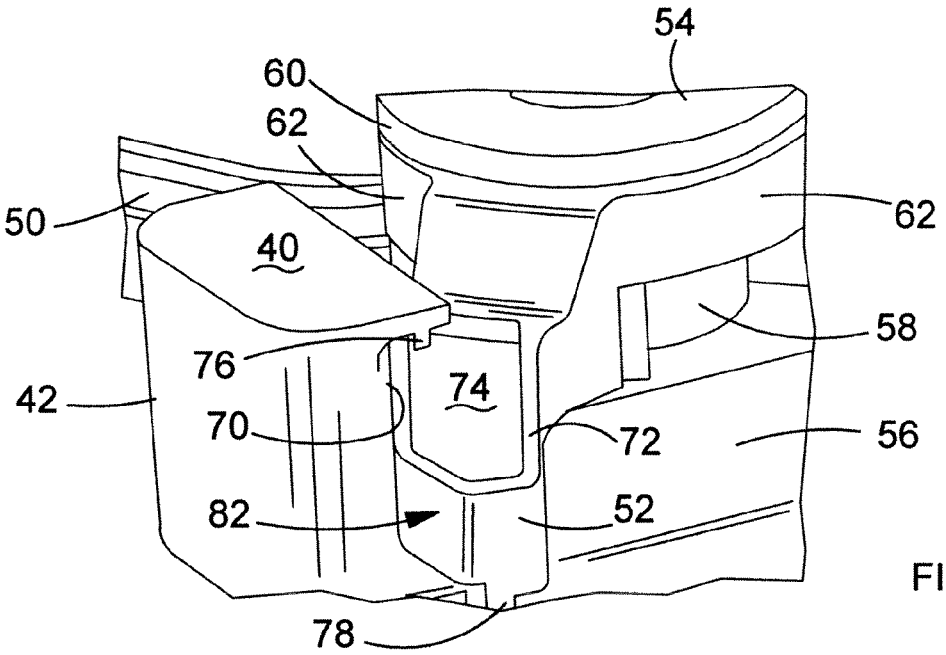
FIG. 7 shows a close-up perspective view of the handle with the pivotal arms in the extended position.
Figure 8:
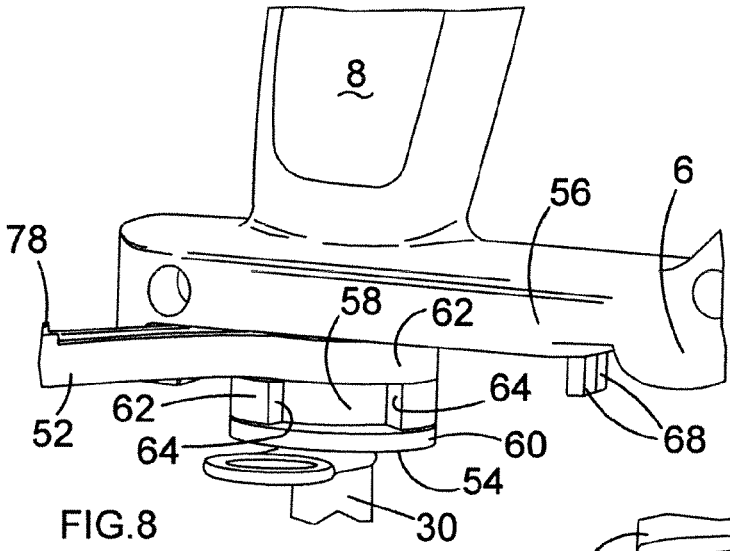
FIG. 8 shows an alternative perspective view of the handle with the pivotal arms in the extended position.

Each pivotal arm 50, 52 may have a ridge 72 formed around the edges of the top surfaces 74. As best seen in FIG. 9, a protrusion 76 may be formed on each side of the stop 40 adjacent the abutment surface 70. When each pivotal arm 50, 52 is moved into its extended position, the ridge 72 of each arm 50, 52 may engage with the protrusion 76 which then rides over the ridge 72 due to it being slightly flexible, and preferably engages with the inner side of the ridge 72 as shown in FIG. 7 to hold the pivotal arm 50, 52 in its extended position. A person of ordinary skill in the art will recognize that it is possible to make the ridge 72 flexible instead of the protrusion 76, or both the ridge 72 and the protrusion 76 flexible, in order for them to function in the same manner.

When each pivotal arm 50, 52 is moved out of its extended position, the protrusion 76 is preferably caused to disengage with the inner side of the ridge 72 and ride over the ridge 72, due to it being slightly flexible, thus releasing it from the extended position. Movement of each arm into or out of the extended position is preferably caused by the operator of the heat gun manually moving the pivotal arm 50, 52.

A second protrusion 78 may be formed on the bottom surface of each pivotal arm 50, 52, preferably at the end of the pivotal arms 50, 52. As best seen in FIG. 4, two corresponding engagement ridges 80 may be formed on the underside of the lower section 56. Accordingly, when each pivotal arm 50, 52 is moved into its retracted position, the second protrusion 78 of each arm 50, 52 preferably engages with the engagement ridge 80 which then rides over the engagement ridge 80 due to being slightly flexible, and preferably engages with the inner side of the engagement ridge 80 to hold the pivotal arm 50, 52 in its retracted position. Persons of ordinary skill in the art will recognize that it is possible to make the engagement ridge 80 flexible instead of the second protrusion 78, or both the engagement ridge 80 and the second protrusion 78 flexible, in order for them to function in the same manner.

When each pivotal arm 50, 52 is moved out of its retracted position, the second protrusion 78 is preferably caused to disengage with the inner side of the engagement ridge 80 and ride over the engagement ridge 80, due to being slightly flexible, thus releasing it from the retracted position. Movement of each arm into or out of the retracted position is preferably caused by the operator of the heat gun manually moving the pivotal arm 50, 52.

When the operator is using the heat gun, the two pivotal arms are preferably moved to their respective retracted position as shown in FIG. 6. Once the operator has finished with the heat gun, the operator needs to place it on a work surface so that the nozzle 16 is preferably located away from the work surface 36. The operator preferably moves the pivotal arms 50, 52 from their retracted positions to their extended positions, locking the arms 50, 52 in the extended positions with the protrusions 76 and ridges. The operator can then place the heat gun on the work surface 36, the flat surface 38 of the base 26, the flat surface 42 of the stop 40 and angled surfaces 82 formed on each arm 50, 52, forming a platform which engages with the work surface 36 as best seen in FIG. 5.

When forming the platform, the flat surface 38 of the base 26, the flat surface 42 of the stop 40 and the angled surfaces 82 formed on each arm 50; 52 are preferably located within the same plane. The use of the two pivotal arms 50, 52 provides greater stability to the heat gun on the work surface 36. Once nozzle 16 is cooled off, the operator can move the arms 50, 52 into their retracted positions where there will be held by the engagement ridges 80 and second protrusions 78. The operator can then hang the heat gun on a hook using a loop 90 mounted on the electric cable 30.

Figure 10:
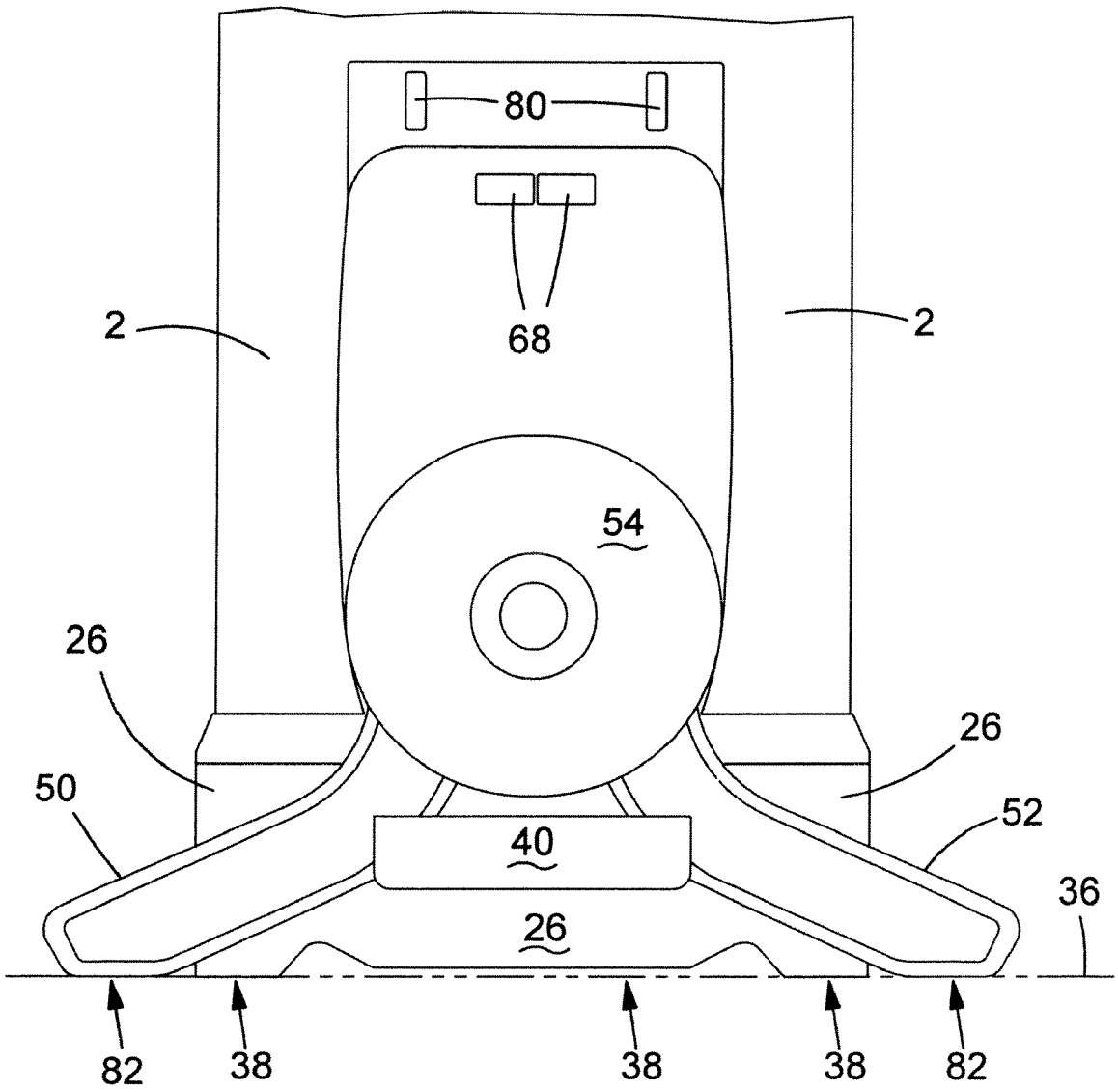
FIG. 10 shows a detailed view of the handle of the second embodiment with the pivotal arms in the extended position.

A second embodiment of the present invention will now be described with reference to FIG. 10. Like numerals refer to like parts. The second embodiment is the similar to the first embodiment except that the stop 40 does not have a flat surface 42 or any other surface which engages the work surface 36. As such, when the heat gun is placed on a work surface, with the two pivotal arms 50, 52 in their extended position, the flat surface 38 of the base 26 and the angled surfaces 82 of the two pivotal arms 50, 52 form a platform which engages with the work surface 36. As there are three points of contact, a stable base will be provided even if the surface is not flat.

Persons skilled in the art may recognize other additions or alternatives to the means disclosed herein. However, all these additions and/or alterations are considered to be equivalents of the present invention.

What is claimed is:

1. A heat gun comprising:

a body having a front portion, a rear portion and a longitudinal axis extending therebetween;

a fan assembly located within the body to generate an air flow;

a heating device located within the body;

a nozzle mounted on the front portion of the body to direct the air flow from the body;

wherein the fan assembly, when activated, blows air over the heating device and then through the nozzle;

a base mounted on the rear portion of the body;

a handle connected to the body, the handle having a longitudinal axis; and a support mechanism mounted on the handle remote from the base which comprises a first arm moveably mounted on the handle and which is capable of moving between a first retracted position and a second extended position and wherein, when the first arm is in the extended position, is capable of co-operating with the base to form a platform upon which the heat gun can rest on a work surface while locating the nozzle away from the work surface;

wherein the first arm is pivotally mounted on the handle, the first arm being capable of pivoting between the first retracted position and the second extended position about an axis generally parallel to the longitudinal axis of the handle.

2. The heat gun of claim 1, wherein a pivoting axis of the first arm is perpendicular to the longitudinal axis of the body.

3. The heat gun of claim 1, wherein the platform is formed from at least two of a support surface on the base, a surface of the first arm when in the extended position, and a support surface on the handle.

4. The heat gun of claim 1, wherein, when the first arm is in the retracted positioned, the first arm is parallel to the longitudinal axis of the body.

5. The heat gun of claim 1, wherein, when the first arm is in the retracted position, a side of the first arm is at least flush with or located inside of a side wall of the handle.

6. The heat gun of claim 1, wherein the first atm is releasably lockable in at least one of the extended and retracted positions.

7. The heat gun of claim 6, further comprising a ridge mounted on the first arm and a protrusion mounted on the handle, the protrusion adapted to ride over and be held by the ridge to lock the first arm in the at least one of the extended and/or retracted positions.

8. The heat gun of claim 7, wherein at least one of the protrusion and the ridge is flexible.

9. The heat gun of claim 1, further comprising a second arm moveably mounted on the handle, the second arm being capable of moving between a first extended position and a second extended position.

10. The heat gun of claim 9, wherein the second arm is pivotally mounted on the handle.

11. The heat gun of claim 10, wherein the first and second arm pivot about a common rotational axis.

* * * * *